United States Patent [19]

Mazzarella

[11] Patent Number: 4,463,516

[45] Date of Patent: Aug. 7, 1984

[54] TOY DOLL WITH SIMULATED GROWING TOOTH

[76] Inventor: Mildred Mazzarella, 2407 Madison Dr., East Meadow, N.Y. 11554

[21] Appl. No.: 412,021

[22] Filed: Aug. 26, 1982

[51] Int. Cl.[3] ..... A63H 3/48

[52] U.S. Cl. ..... 446/320; 446/339

[58] Field of Search ..... 46/135 R, 171, 164, 46/141, 123

[56] References Cited

U.S. PATENT DOCUMENTS

| | | | |
|---|---|---|---|
| 2,448,088 | 8/1948 | Driggs | 46/123 |
| 2,556,304 | 6/1951 | Velkas et al. | 46/171 |
| 3,535,818 | 10/1970 | Pajak | 46/135 R |
| 3,696,551 | 10/1972 | Sklarsky et al. | 46/135 R |

*Primary Examiner*—Robert A. Hafer

*Assistant Examiner*—William H. Honaker

*Attorney, Agent, or Firm*—Grimes & Battersby

[57] ABSTRACT

The present invention relates generally to a toy doll head of the type having a mouth opening and at least one simulated tooth adapted to alternatively extend into the mouth opening in an exposed position and then be retracted into the doll head in a retracted position. The head includes internal mechanical growth means for causing the tooth to alternately be extended into and be retracted from the mouth, the internal growth means being adapted to releasably secure the tooth in either position as well as between positions. The internal growth means comprises an elongated shaft including at least one simulated tooth at one end and control means at the opposite end. The shaft is maintained in proper alignment by at least one brace internally mounted on the inside of the doll head.

3 Claims, 6 Drawing Figures

TOY DOLL WITH SIMULATED GROWING TOOTH

BACKGROUND OF THE INVENTION

The present invention relates generally to a toy doll head with a simulated growing tooth and, more particularly, to such a doll head of the type having an open mouth and a simulated tooth which is adapted to be easily introduced into said mouth in an exposed position and alternately retracted into the head in a retracted position.

Toy doll heads having simulated growing teeth are well known. For example, U.S. Pat. No. 2,556,304 which issued on June 12, 1951 to G. Velkas et al., describes such a doll head wherein two simulated teeth are alternately introduced into its mouth opening and then retracted into the doll head by the use of spring or cam operated means.

Similarly, U.S. Pat. No. 3,535,818, which issued to W. Pajak on Oct. 27, 1970, also describes a doll head having a simulated growing tooth utilizing a mechanism whereby the tooth is held in either a retracted or exposed position unless a positive pressure is exerted on one of its component parts. A complex spring loaded mechanism is provided for introducing the tooth into the mouth of the doll head or retracting it into its head.

It will readily be appreciated that the mechanisms for causing "growth" of the simulated teeth in the doll heads described in these two issued patents are extremely complex and, accordingly, not only add additional cost to the ultimate price of the doll but, due to their complex spring and cam operations, are extremely fragile and run a substantially greater risk of breakage during use.

Against the foregoing background, it is an object of the present invention to provide a toy doll head of the type having a simulated growing tooth which is maintained in either a retracted or an exposed position as well as in intermediate positions therebetween.

It is a further object of the present invention to provide such a toy doll head whereby the mechanism for effecting "growth" of the tooth involves a minimum of moving parts and is relatively simple to operate.

SUMMARY OF THE PRESENT INVENTION

The present invention relates generally to a toy doll head of the type having a mouth opening and a simulated tooth adapted alternatively to be extended into said opening in an exposed position and retracted into said head in a retracted position. The doll head further includes internal mechanical growth means for causing said tooth to alternately be exposed and retracted, said internal growth means being adapted to releasably secure said tooth in either of said positions as well as in intermediate positions therebetween. The growth means comprise an elongated shaft including a simulated tooth at one end thereof and control means at the opposite end thereof. The shaft, which includes a plurality of detents on one side thereof, is maintained in proper alignment through the use of at least one and preferably two braces internally secured to the inside of said doll head. The control means at the opposite end of said shaft extends through a keyhole opening at the top of the doll head which, in combination with a detent contained on said shaft, effects locking of the simulated tooth in either an exposed or a retracted position. The plurality of detents on said shaft are adapted to engage with intermediate locking means on at least one of said braces in order to maintain the tooth in an intermediate position.

BRIEF DESCRIPTION OF THE DRAWINGS

The foregoing objects and advantages of the subject invention will be readily apparent in the course of the following detailed description taken in connection with the accompanying drawings which illustrate a preferred embodiment of the invention and wherein.

DESCRIPTION OF THE PREFERRED EMBODIMENTS

Figure 1:
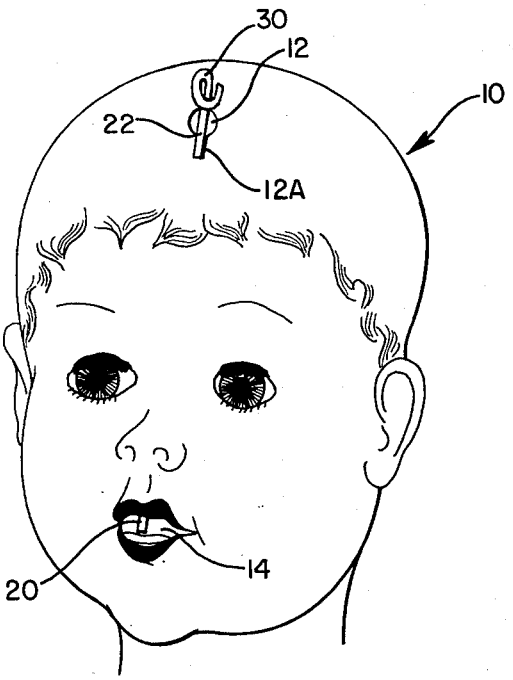
FIG. 1 is a front view of the toy doll head of present invention.
Figure 2:
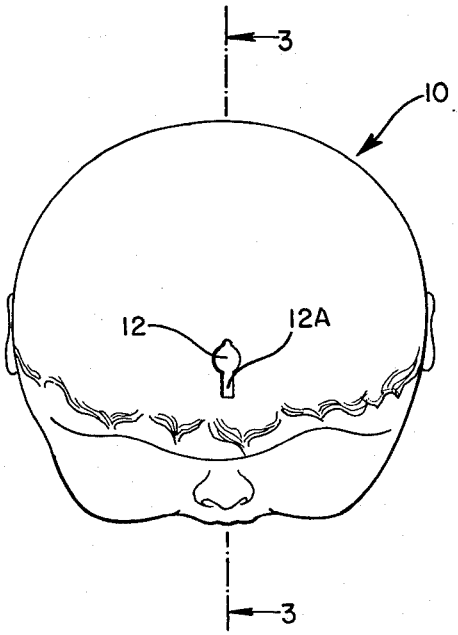
FIG. 2 is a top view thereof.

The toy doll head of the present invention is illustrated generally in FIGS. 1 and 2. The toy doll head, referred to generally by reference numeral 10, appears as an otherwise conventional toy doll head, however it includes a keyhole-shaped opening 12 with a rectangular portion 12A at the top portion of the head and a mouth opening 14. One or more simulated teeth 20 are adapted to be introduced into the mouth opening 14 by internally contained mechanical growth means 21 shown in greater detail in FIGS. 3 and 4.

Figure 5:
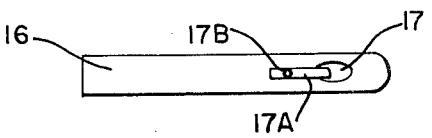
FIG. 5 is a top plan view of one of the braces of the subject invention.
Figure 6:
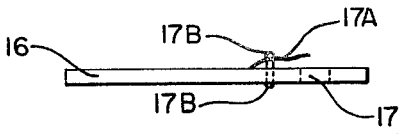
FIG. 6 is a side elevational view of the brace of FIG. 5.

Mechanical growth means 21 include a shaft 22 which includes a simulated tooth or teeth 20 at one end thereof and a control handle 30 at its opposite end which extends outwardly from the doll head 10 through keyhole opening 12. Control handle 30 may be shaped or otherwise configured as a "curl". Shaft 22, which includes a plurality of intermediate detents 23 on one side thereof is maintained in proper alignment by at least one and preferably a plurality of braces 16 which are secured to the internal portion of head 10. As shown in greater detail in FIG. 5, braces 16 include an aperture 17 through which shaft 22 passes. An intermediate locking member 17A is provided on at least one brace 16 adapted to engage intermediate detents 23 on shaft 22 to lock the tooth in an intermediate position. A plurality of stops 24 and 26 are provided on the shaft 22 and a detent 28 is provided between upper shaft 26 and control means 30. Detent 28 is provided on the same side of shaft 22 as intermediate detents 23. At least one aperture 15 is provided at the top or roof of the open mouth 14 to permit the one or more simulated teeth 20 to pass therethrough.

Figure 3:
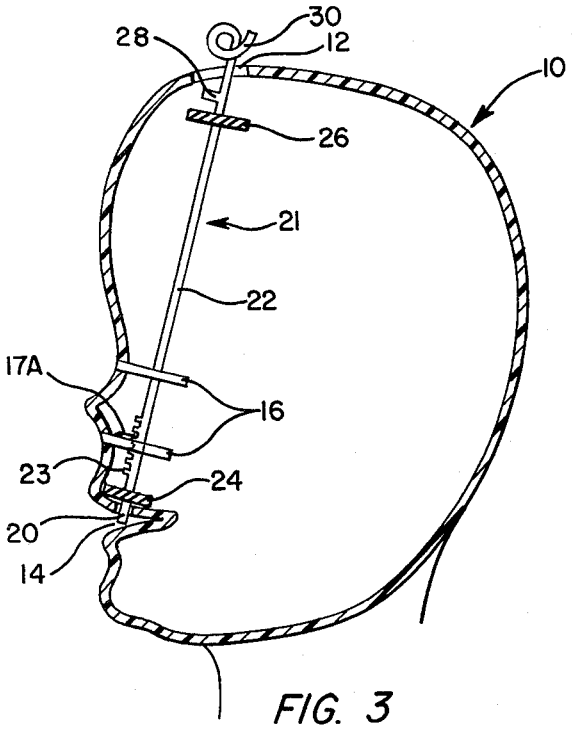
FIG. 3 is a cut-away side view of the toy doll head of the subject invention taken along line 3—3 of FIG. 2 illustrating the internal mechanism projecting the simulated tooth in an exposed position.
Figure 4:
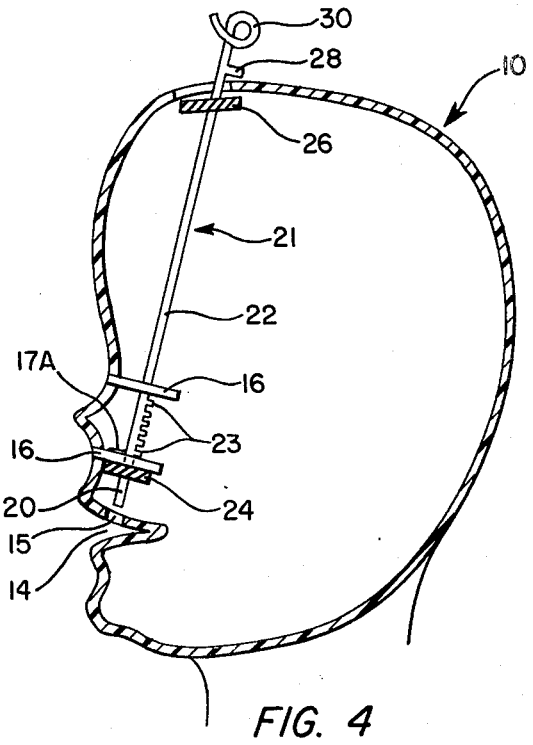
FIG. 4 is a cut-away side view of the toy doll head of the subject invention taken along line 3—3 of FIG. 2 illustrating the internal mechanism with the simulated tooth in a retracted position.

The actual operation of mechanical growth means 21 for exposing and retracting the simulated tooth 20 is illustrated in greater detail in FIGS. 3 and 4. As shown for example in FIG. 3, the simulated tooth 20 is illustrated in an exposed position. It will be appreciated that in order to so expose the simulated tooth 20, shaft 22 is rotated by control means 30 until detent 28 is aligned with the rectangular portion 12A of keyhole opening 12 permitting shaft 22 with the simulated tooth 20 at one end thereof to be depressed downwardly such that the tooth 20 passes through the aperture 15 at the roof of the mouth opening 14 and becomes exposed. The tooth 20 is indexed downwardly in intermediate steps as intermediate detents engage locking member 17A. Such engagement permits intermediate positioning of the tooth 20. Further movement of shaft 22 and simulated tooth 20 upon full depression is prevented by engagement of lower stop 24 against the roof of the mouth 14. If desired, control 30 may be rotated so that detent 28 is no longer aligned with the rectangular portion 12A of keyhole opening 12 thus locking the tooth 20 in a fully downwardly exposed position.

FIG. 4 is illustrative of the manner in which the simulated tooth 20 is retracted into the doll head 10. By rotating control 30, shaft 22 is similarly rotated such that detent 28 is aligned with the rectangular portion 12A of keyhole opening 12. Further, rotation of the shaft 22 forces intermediate detents 23 from locking member 17A. Shaft 22 with the simulated tooth 20 at its opposite end is then drawn upwardly until detent 28 passes through keyhole opening 12 and the tooth 20 is retracted through aperture 15. Further upward movement of shaft 22 is prevented by lower stop 24 contacting brace 16. The tooth 20 may then be locked in a retracted position by rotating control 30 and shaft 22 such that detent 28 is no longer aligned with the rectangular portion 12A of opening 12. Lowering of the tooth 20 is then prohibited by the inability of detent 28 to pass through the round portion of keyhole opening 12.

It will be appreciated that the aforementioned operation may be mechanized by using conventional mechanical means. For example, a gear wheel (not shown) may be internally positioned for engaging intermediate detents 23 on shaft 22 to permit either manual or automatic depression or retraction of the tooth 20. Manual means may include an external dial adapted to turn the gear wheel causing shaft 22 to move downwardly or upwardly. Automatic means could include a timer or clock mechanism internally contained causing the gear wheel to rotate.

It will be appreciated that subject matter of the present invention may be modified or otherwise changed without departing from the spirit and scope of the subject invention which is defined by the following appended claims.

What is claimed is:

1. A doll head of the type having a mouth and at least one simulated tooth adapted to alternately extend into said mouth in an extended position, be retracted into said head in a retracted position and be maintained in one or more intermediate positions therebetween, said head including mechanical growth means for causing said simulated tooth to alternately assume said extended, retracted and intermedate positions and comprising an elongated shaft which extends into the mouth at one end and out of the top at the opposite end of said doll head through a key-hole shaped opening with a circular and a rectangular portion, said elongated shaft having at least one simulated tooth at said one end, control means at said opposite end, a detent on one side of said shaft in relatively close proximity to said control means adapted to only be able to pass through said key-hole shaped opening when said detent is aligned with the rectangular position of said opening and be denied passage when the detent is aligned with the circular portion of said opening and a plurality of intermediate locking detent on the same side of said elongated shaft as said detent, and at least one brace internally mounted within said doll head and including an aperture through which said elongated shaft extends and a locking mechanism adapted to engage one or more of said intermediate detents in order to retain said elongated shaft and said simulated tooth in one or more intermediate positions, wherein said control means are adapted to cause said simulated tooth to progressively extend from a retracted position through one or more intermediate positions to an extended position by causing the elongated shaft to rotate such that the detent is in alignment with the rectangular position of the keyhole opening to permit passage therethrough and then to sequentially progress through the intermediate positions to the extended position by downward depression of the control means.

2. The doll head of claim 1 wherein said shaft includes a plurality of stops one of which is provided between the detent and the intermediate detents and wherein a second stop is provided between the simulated tooth and the intermediate detents.

3. The doll head of claim 2, wherein the second stop is adapted to prevent said mechanical growth means from causing the simulated tooth to extend beyond the extended position.

* * * * *